United States Patent [19]

Kawakami et al.

[11] Patent Number: 4,786,629

[45] Date of Patent: Nov. 22, 1988

[54] HEAT-SENSITIVE RECORDING MATERIAL

[75] Inventors: Hiroshi Kawakami; Akira Igarashi, both of Shizuoka, Japan

[73] Assignee: Fuji Photo Film Co., Ltd., Kanagawa, Japan

[21] Appl. No.: 98,331

[22] Filed: Sep. 18, 1987

[30] Foreign Application Priority Data

Sep. 18, 1986 [JP] Japan ..... 61-220507

[51] Int. Cl.[4] ..... B41M 5/18

[52] U.S. Cl. ..... 503/200; 428/207; 428/537.5; 428/913; 428/914; 503/226

[58] Field of Search ..... 428/195, 207, 537.5, 428/913, 914; 503/200, 206

[56] References Cited

U.S. PATENT DOCUMENTS

| | | | |
|---|---|---|---|
| 4,333,984 | 6/1982 | Igarashi et al. | 428/913 |
| 4,416,939 | 11/1983 | Igarashi et al. | 428/913 |
| 4,490,732 | 12/1984 | Maekawa et al. | 503/200 |

*Primary Examiner*—Bruce H. Hess

*Attorney, Agent, or Firm*—Sughrue, Mion, Zinn, Macpeak & Seas

[57] ABSTRACT

A heat-sensitive recording material comprising a support provided thereon a heat-sensitive color forming layer comprising an electron donating dye precursor and an electron accepting compound, wherein the support has an oil absorption degree defined according to JIS-P8130 of 10 seconds or less and heat-fusible components contained in the heat-sensitive color forming layer have a fused viscosity at 150° C. of 10 cp or less.

6 Claims, No Drawings

HEAT-SENSITIVE RECORDING MATERIAL

FIELD OF THE INVENTION

The present invention relates to a heat-sensitive recording materials, and more particularly it relates to a heat-sensitive recording material comprising a support having provided thereon a heat-sensitive color forming layer containing an electron donating dye precursor and an electron accepting compound.

BACKGROUND OF THE INVENTION

Heat-sensitive recording materials using an electron donating dye precursor and an electron accepting compound are disclosed in Japanese Patent Publication Nos. 14039/70 (corresponding to U.S. Pat. No. 3,539,375) and 4160/68. As the recording rate of heat-sensitive recording systems is increased and color formation with low energy input is improved as is the case recently, studies to make a heat-sensitive recording material more highly sensitive have been extensively conducted. As one approach, various heat-fusible substances have been added to the heat-sensitive color forming layer to increase color forming sensitivities. However, those heat-sensitive recording materials having high color forming sensitivities have a drawback for facsimile transmissions in that head stain readily takes place where stain adheres the thermal head.

SUMMARY OF THE INVENTION

An object of the present invention is to provide a heat-sensitive material having high color forming sensitivities and which is capable of reducing head stain.

This and other objects have been attained by providing a heat-sensitive recording material comprising a support provided thereon a heat-sensitive color forming layer comprising an electron donating dye precursor and an electron accepting compound, wherein the support has an oil absorption degree defined according to JIS-P8130 of 10 seconds or less and heat-fusible components contained in the heat-sensitive color forming layer have a fused viscosity at 150° C. of 10 cp or less.

DETAILED DESCRIPTION OF THE INVENTION

As mentioned above, the present invention provides a heat-sensitive recording material comprising a support having provided thereon a heat-sensitive color forming layer comprising an electron donating dye precursor and an electron accepting compound, wherein the support has an oil absorption degree defined according to JIS-P8130 of 10 seconds or less and heat-fusible components contained in the heat-sensitive color forming layer have a fused viscosity of 10 cp or less at 150° C. It is preferred that the oil absorption degree of the support is 8 seconds or less and that the fused viscosity of the heat-fusible components is 8 cp or less at 150° C., and the above-described combination is even more preferred.

The methods for preparing the support of the present invention include (1) incorporating a high oil absorbent pigment into a support or adding the high oil absorbent pigment upon preparing the paper when the support is paper; (2) providing on a support a subbing layer mainly containing a high oil absorbent pigment; and (3) using a porous high molecular weight film (such as those which can be used as a microfilter) as a support.

The above-described high oil absorbent pigments are preferably those that have an oil absorbing degree defined according to JIS-K5101 of 40 cc/100 g or more, such as calcium carbonate, barium sulfate, titanium oxide, talc, agalmatolite, kaolin, calcined kaolin, aluminum hydroxide, amorphous silica, uric acid and formalin resin particles or polyethylene resin particles.

When the above-described pigments are added as a filling material upon preparation of paper, the additive amount thereof is preferably from 20 wt % to 50 wt % based on the weight of the pulp. When the pigments are coated on a support to provide a subbing layer, the amount of the pigments is 2 $g/m^2$ or more, preferably 4 $g/m^2$ or more. Such a subbing layer also includes a binder.

Suitable binders which can be used for the subbing layer include water-soluble high molecular weight substances and water-insoluble binders, which are used alone or in combination.

Suitable water-soluble high molecular weight substances include methylcellulose, carboxymethylcellulose, hydroxyethyl cellulose, starches, gelatin, gum arabic, casein, hydrolysis products of copolymers of styrene and maleic anhydride, hydrolysis products of copolymers of ethylene and maleic anhydride, hydrolysis products of copolymers of isobutylene and maleic anhydride, polyvinyl alcohol, carboxy modified polyvinyl alcohol and polyacrylamide.

Suitable water insoluble binders include generally synthetic rubber latexes and synthetic resin emulsions, such as styrene and butadiene rubber latex, acrylonitrile and butadiene rubber latex, methyl acrylate and butadiene rubber latex or a vinyl acetate emulsion.

The additive amount of binders is from 3 to 100%, preferably from 5 to 50% based on the weight of the pigments. Wax, fade preventing agents and surface active agents can be added to the subbing layer, if desired.

According to the present inovation, the final support should have an oil absorption degree defined according to JIS-P8130 of 10 seconds or less, preferably 8 seconds or less.

The heat-fusible components contained in the heat-sensitive color forming layer include an electron donating dye precursor (hereinafter referred to as a "color former"), an electron accepting compound (hereinafter referred to as a "developer") and any further heat-fusible substances contained therein which acts as a sensitizing agent.

According to the present inovation, the fused viscosity of the heat-fusible components is 10 cp or less at 150° C., preferably 8 cp or less at 150° C.

The fused viscosity refers to the viscosity of the heated and melted above-described heat-fusible components having been mixed in a predetermined mixing ration and can be measured by a conventional viscosity meter equipped with a heating and heat-preserving device at the measuring cell.

The heat-sensitive color forming layer of the present invention can be prepared by selecting a particular color former, developer and, if desired, other heat-fusible component (i.e., a sensitizing agent), as well as the mixing ratio thereof. As the sensitizing agent, use of a sensitizing agent having a low fused viscosity (preferably 10 cp or less, more preferably 5 cp or less) is generally the preferred.

When the sensitizing agent is not used, a developer having a low fused viscosity is used in a relatively large amount.

Examples of the sensitizing agents include organic compounds having at least one ether bond in the molecule and having a melting point of from 70° C. to 150° C. When the melting point is 70° C. or lower, the color forming initiating temperature falls to room temperature, thereby causing fog formation. Specific examples of the sensitizing agent are those represented by the following formulae (I) to (IV).

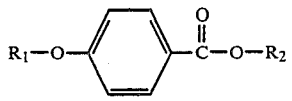
(I)

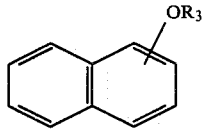
(II)

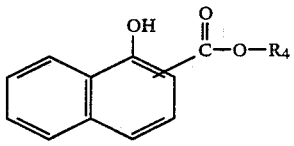
(III)

In the formulae (I) to (III), $R_1$ through $R_4$ each represents a phenyl group, and a benzyl group, which may be substituted with a lower alkyl group, one or more halogen atoms a hydroxy group or an alkoxy group.

In the formulae (I) through (III), when a phenyl group or a benzyl group is substituted with a lower alkyl group, the number of carbon atoms thereof is from 1 to 8, preferably from 1 to 3. When a phenyl or a benzyl group is substituted with halogens, preferred halogens are chlorine and fluorine.

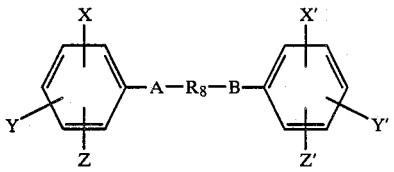
(IV)

In the formula (IV), $R_8$ represents a divalent group, preferably an alkylene group, an alkylene group having an ether bond, an alkylene group having a carbonyl group, an alkylene group having one or more halogen atoms, an alkylene group having an unsaturated bond, more preferably an alkylene group and an alkylene group having an ether bond. A and B represent O or S and may be the same or different. X, Y, Z, X', Y', and Z', are the same or different and represent a hydrogen atom, an alkyl group, a lower alkoxy group, a lower aralkyl group, a halogen atom, an alkyloxycarbonyl group and an aralkyloxycarbonyl group.

Specific examples of sensitizing agents include benzyl p-benzyloxybenzoate, β-naphthylbenzyl ether, phenyl β-naphthoate, phenyl 1-hydroxy-2-naphthoate, β-naphthol (p-chlorobenzyl) ether, α-naphtholbenzyl ether, 1,4-butan-diol-p-methylphenyl ether, 1,4-butandiol-p-methyl-phenyl ether, 1,4-butandiol-p-isopropylphenyl ether, 1,4-butandiol-p-t-octylphenyl ether, 2-phenoxy-1-p-tolyloxyethane, 1-phenoxy-2-(4-ethylphenoxy) ethane, 1-phenoxy-2-(4-chlorophenoxy) ethane and 1,4-butandiolphenyl ether, (4,4'-methoxyphenylthio) ethane.

Among the above, β-naphthylbenzyl ether, 1,4-butandiol-p-methylphenyl ether, 1-phenoxy-2-(4-ethylphenoxy) ethane, and 1,4-butandiolphenyl ether are preferred.

In addition to the above, wax may be used as the heat-fusible component.

The amount of the color former used in the heat-sensitive color forming layer of the present invention is preferably from 0.1 to 1.0 g/m$^2$. The amount of the developer in the heat-sensitive color forming layer of the present invention is preferably from 10 to 1,000 wt % of the amount color former, and more preferably from 0.2 to 2.0 g/m$^2$. The amount of the sensitizing agent in the heat-sensitive color forming layer of the present invention is preferably from 0 to 1,000 wt %, more preferably from 20 to 500 wt %, and particularly preferably from 50 to 200 wt % of the amount of the color former.

The above sensitizing agents may be used alone or in combination.

A method for preparing the heat-sensitive recording material of the present invention is illustrated below. The heat-sensitive recording material of the present invention is prepared by dispersing a color former and a developer separately in separate ball mills or sand mills to prepare particles having a particle size of several microns and thereafter mixing the two dispersions. The color former and the developer are generally dispersed with an aqueous solution of water-soluble high molecular weight substances such as polyvinyl alcohol and, if necessary, a sensitizing agent is dispersed and added thereto. The sensitizing agent may be added to one or both of the color former and the developer and may be dispersed together with the color former or developer.

Suitable color formers used in the present invention include triarylmethane type compounds, diphenylmethane type compounds, xanthene type compounds, thiazine type compounds and spiropyran type compounds. More specifically, triarylmethane type compounds include 3,3-bis(p-dimethylaminophenyl)-6-dimethylaminophthalide (i.e., crystal violet lactone), 3,3-bis(p-dimethylaminophenyl) phthalide, 3-(p-dimethylaminophenyl)-3-(1,3-dimethylindol-3-yl)phthalide and 3-(p-dimethylaminophenyl)-3-(2-methylindol-3-yl)phthalide; diphenylmethane type compounds include 4,4'-bis-dimethylaminobenzhydrinbenzyl ether, N-halophenyl-leucoauramine and N-2,4,5-trichlorophenyl leucoauramine; xanthene compounds include rhodamine-β-anilinolactam, rhodamine(p-nitroanilino)-lactam, rhodamine-β(p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-N-cyclohexyl-N-methylaminofluoran, 2-anilino-3-methyl-6-N-isoamylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6-diethylaminofluoran, 2-butylamino-3-chloro-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-3-methyl-6-diphenylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-diethylaminofluoran, 2-phenyl-6-diethylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoacylaminofluoran, 2-anilino-3-methyl-6-N-ethyl-N-γ-methoxypropylaminofluoran, 2-anilino-3-phenyl-6-diethylaminofluoran, 2-diethylamino-3-phenyl-6-diethylaminofluoran, and 2-anilino-3-methyl-6-N-isoamyl-N-ethylaminofluoran; thiazine type compounds include benzoylleucomethylene blue and p-nitrobenzyl leucomethylene blue; and spiropyran type compounds include 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo) spiropyran and 3-propyl-spiro-benzopyran. Among the above, xanthene compounds are preferred. The color formers are used alone or in combination to adjust color hue and to improve image storage stability.

Suitable developers used in the present invention include bisphenols such as 2,2-bis(4'-hydroxyphenyl)-propane (bis-phenol A), 2,2-bis(4-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4'-hydroxyphenyl)-2-ethylhexane and 1,1-bis(4'-hydroxyphenyl)dodecan; salicylic acids such as 3,5-di-α-methylbenzyl salicylic acid, 3,5-di-tertiarybutyl salicylic acid or 3-α,α-dimethylbenzyl salicylic acid and the polyhydric metal salts thereof (particularly salts of zinc and aluminum are preferred); oxybenzoates such as benzyl p-hydroxybenzoate or 2-ethylhexyl p-hydroxylbenzoate; and phenols such as p-phenylphenol, 3,5-diphenylphenol or cumyl phenol. Bisphenols are the most preferred of all.

With respect to binders and pigments for the heat-sensitive layer, those water-soluble high molecular weight and water-insoluble binders and pigments used for the subbing layer can be used.

Suitable metal soaps used in the present invention include higher fatty acid metal salts such as zinc stearate, calcium stearate or aluminum stearate.

Suitable wax used in the present invention is polyethylene wax, carnaubau wax, paraffin wax, microcrystaline wax and fatty acid amide.

If necessary, antioxidants, ultraviolet absorbents and image storage stability improving agents can be added to the heat-sensitive color forming layer.

Suitable image storage stability improving agents are phenols having at least one alkyl group substituent at the 2- or 6-position and derivatives thereof, and phenols having at least one branched alkyl group substituent at the 2- or 6-position and derivatives thereof are preferred. Image storage stability improving agents having a multiple number of phenol groups in the molecule and particularly image storage stability improving agents having two or three phenol groups are preferred.

The heat-sensitive material according to the present invention may further comprise a subbing layer, a protective layer, etc.

The present invention will now be illustrated in more detail by the following Examples, but the invention is not to be construed as being thereto.

EXAMPLES

In the examples, each heat-sensitive recording material was obtained by coating each coating solution with a wire bar on its support so that the dry coating amount was 6 g/m$^2$ and drying it in an oven at 50° C.

Preparation of an under coated base:

80 g of calcined kaolin ("Ansilex 90", manufactured by Engelhardt Co., Ltd.) as a pigment and 160 g of a 0.5% aqueous solution of sodium hexamethaphosphate were dispersed in a homogenizer. 40 g of 10% polyvinyl alcohol ("PVA-105", manufactured by KURARAY CO., LTD.) was added to the resulting dispersion to prepare a coating solution. The coating solution was coated with a wire bar on a high quality paper having a basis weight of 50 g/m$^2$ so that the dry coating amount was 6 g/m$^2$ and was dried in an oven at 50° C. to obtain an undercoated base. The oil absorption degree of the undercoated base was 4 seconds. (The degree of the original high quality paper was 15 seconds.)

Preparation of coating solution A:

20 g each. of 2-anilino-3-methyl-N-methyl-N-cyclohexylaminofluoran as a color former, bisphenol A as a developer and β-naphthyl benzyl ether as a sensitizing agent were dispersed in a ball mill for one day and one night each with 100 g of a 5% aqueous solution of polyvinyl alcohol ("PVA-105", manufactured by KURARAY Co., Ltd.). The volume average particle diameter of the dispersion was 3 μm or less. 80 g of calcium carbonate ("Unibur 70", manufactured by Shiraishi Kogyo Co., Ltd.) as a pigment and 160 g of a 0.5% aqueous solution of sodium hexamethaphosphate were dispersed in homogenizer. With regard to the thus obtained dispersions, 5 g of the dispersion of 2-anilino-3-methyl-6-N-methyl-N-cyclohexylaminofluoran, 10 g of the dispersion of bisphenol A, 10 gm of the dispersion of β-naphthylbenzyl ether and 15 g of the dispersion of calcium carbonate were mixed and 3 g of the dispersion of 21% zinc stearate was added thereto to obtain a coating solution A.

Preparation of coating solution B:

1-phenoxy-2-(4-ethylphenoxy)ethane was used as a sensitizing agent to obtain a coating solution B instead of β-naphthylbenzyl ether contained in coating solution A.

Preparation of coating solution C:

(4,4'-methoxyphenylthio)ethane was used instead of β-naphthylbenzyl ether contained in coating solution A as a sensitizing agent to obtain a coating solution C.

Preparation of coating solution D:

The coating solution D was prepared without using β-naphthylbenzyl ether used as a sensitizing agent contained in the coating solution A.

EXAMPLE 1

A heat-sensitive recording material was prepared by coating the coating solution A on the undercoated base.

EXAMPLE 2

A heat-sensitive recording material was prepared by coating the coating solution B on the undercoated base.

EXAMPLE 3

A heat-sensitive recording material was prepared by coating the coating solution C on the undercoated base.

COMPARATIVE EXAMPLE 1

A heat-sensitive recording material was prepared by coating the coating solution D on the undercoated base.

COMPARATIVE EXAMPLE 2

A heat-sensitive recording material was prepared by coating the coating solution A on high quality paper that did not have an undercoating.

COMPARATIVE EXAMPLE 3

A heat-sensitive recording material was prepared using a printing energy of 30 mJ/mm$^2$ with a print tester by coating the coating solution D on high quality paper that did not have an undercoating.

The thus obtained samples were printed using a print tester manufactured by Kyocera Co., Ltd. with a printing energy of 30 mJ/mm$^2$, and the print density was measured by a Macbeth densitometer. Head stain was visually observed using a high speed facsimile "UF-2" manufactured by Matsushita Graphic Communication Systems, Inc. by copying 100 copies of a test chart No. 2 prepared by The Electric Image Society.

The fused viscosity was measured using an E form viscometer manufactured by TOKYO KEIKI CO., LTD. equipped with a sample adapter (H form adapter) and HM-1. The viscosity was measured at 100 rpm by introducing the heat fusible components in a sample cup, inserting them into a viscoblock and heating to 150° C.

The results are shown in Table 1.

From the results shown in Table 1, the heat-sensitive recording materials according to the present invention are excellent in both the color forming sensitivity and the prevention of heat stain.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support provided thereon a heat-sensitive color forming layer comprising an electron donating dye precursor and an electron accepting compound, wherein said support has an oil absorption degree defined according to JIS-P8130 of 10 seconds or less and heat-fusible components contained in said heat-sensitive color forming layer have a fused viscosity at 150° C. of 10 cp or less.

2. A heat-sensitive recording material as claimed in claim 1, wherein said support has an oil absorption degree defined according to JIS-P8130 of 8 seconds or less.

3. A heat-sensitive recording material as claimed in claim 2, wherein said heat-fusable components have a fused viscosity at 150° C. of 8 cp or less.

4. A heat-sensitive recording material as claimed in claim 1, wherein said heat-fusible components have a fused viscosity at 150° C. of 8 cp or less.

5. A heat-sensitive recording material as claimed in claim 1, wherein a high oil absorbent pigment having an

TABLE 1

| Sample No. | Sensitizing agent | Support | Fused viscosity (cp) | Oil absorption degree of support (sec) | Color density | Head stain* |
|---|---|---|---|---|---|---|
| Example 1 | 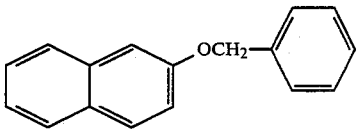 | Undercoated base | 4.2 | 4 | 1.05 | B |
| Example 2 | 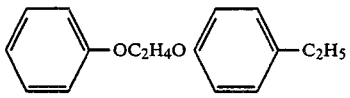 | Undercoated base | 3.4 | 4 | 1.19 | B |
| Example 3 | 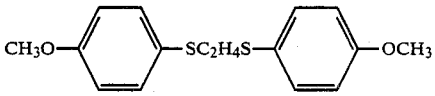 | Undercoated base | 7.3 | 4 | 1.14 | A |
| Comparative Example 1 | none. | Undercoated base | 45.0 | 4 | 0.42 | A |
| Comparative Example 2 | 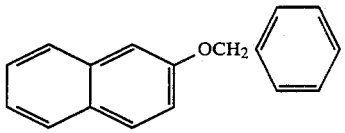 | High quality paper | 4.2 | 15 | 1.00 | D |
| Coamparative Example 3 | none. | High quality paper | 45.0 | 15 | 0.33 | B |

Remarks: *
A: very excellent
B: excellent
C: practically negligible
D: unpractical oil absorption degree defined according to JIS-K5101 of 40 cc/100 g or more is incorporated in or coated on said support.

6. A heat-sensitive recording material as claimed in claim 1, wherein a sensitizer containing at least one ether bond in the molecule and having a melting point of from 70 to 150° C. is incorporated in said heat-sensitive color forming layer.

* * * * *